US005634310A

United States Patent [19]

Hohmann

[11] Patent Number: 5,634,310

[45] **Date of Patent: *Jun. 3, 1997**

[54] SURFACE-MOUNTED VENEER ANCHOR

[75] Inventor: Ronald P. Hohmann, Syosset, N.Y.

[73] Assignee: Hohmann & Barnard, Inc., Hauppauge, N.Y.

[ * ] Notice: The term of this patent shall not extend beyond the expiration date of Pat. No. 5,454,200.

[21] Appl. No.: 427,198

[22] Filed: Apr. 24, 1995

Related U.S. Application Data

[63] Continuation-in-part of Ser. No. 145,583, Nov. 4, 1993, abandoned.

[51] Int. Cl.[6] ..... E04B 2/30; E04B 1/38

[52] U.S. Cl. ..... 52/513; 52/407.4; 52/508; 52/565; 52/713

[58] Field of Search ..... 52/379, 383, 404.3, 52/404.5, 405.1, 407.1, 407.4, 506.05, 508, 512, 513, 562, 565, 568, 712, 713, 714

[56] References Cited

U.S. PATENT DOCUMENTS

| | | | |
|---|---|---|---|
| 1,828,618 | 10/1931 | Pieters | 52/379 |
| 3,292,336 | 12/1966 | Brynjolfsson et al. | 52/562 X |
| 3,377,764 | 4/1968 | Storch | 52/713 |
| 4,598,518 | 7/1986 | Hohmann | 52/410 |
| 4,852,320 | 8/1989 | Ballantyne | 52/562 X |
| 4,875,319 | 10/1989 | Hohmann | 52/383 |
| 4,955,172 | 9/1990 | Pierson | 52/383 X |
| 5,207,043 | 5/1993 | McGee et al. | 52/379 |
| 5,408,798 | 4/1995 | Hohmann | 52/562 |
| 5,440,854 | 8/1995 | Hohmann | 52/508 X |
| 5,454,200 | 10/1995 | Hohmann | 52/513 |

*Primary Examiner*—Carl D. Friedman
*Assistant Examiner*—Kevin D. Wilkens
*Attorney, Agent, or Firm*—Siegmar Silber

[57] ABSTRACT

A surface-mounted veneer anchor is disclosed. The anchoring system has a unique combination of a masonry anchor, a box tie member, and a facing anchor is provided. The primary components of the veneer anchor are wire formatives and provide a closed loop, wire-to-wire connections therebetween. In one embodiment, the inner wythe is constructed from a masonry block material, the masonry anchor has a baseplate with a wire formative attached thereto having elongated eye wire extensions. The elongated eye wires extend into the cavity between the wythes. Each pair of eye wires accommodates the threading thereonto of a box tie through the open end of the box tie. The box tie is then positioned so that the open end is utilizable as part of the facing anchor. The baseplate of the masonry anchor is surface-mounted onto the masonry block of the interior wythe. The facing anchor has a straight wire run and mounted along the exterior wythe to receive the open end of wire box tie with each leg thereof being placed adjacent one side of reinforcement wire. The facing anchor is embedded in a bed joint of the exterior wythe. As the elongated eye wires have sealed eyelets or loops and the open ends of the box ties are sealed in the joints of the exterior wythes, a positive, closed-loop interengagement results.

20 Claims, 6 Drawing Sheets

SURFACE-MOUNTED VENEER ANCHOR

CROSS-REFERENCES TO RELATED APPLICATIONS

This application is a Continuation-in-Part of U.S. patent application Ser. No. 08/145,583 entitled Seismic Construction System for Insulated Wall System now abandoned; and further is related to U.S. patent application Ser. No. 08/145,584, now U.S. Pat. No. 5,454,200, issued Oct. 3, 1995, entitled Veneer Anchoring System; and, U.S. patent application Ser. No. 08/145,585, now U.S. Pat. No. 5,408,798, issued Apr. 25, 1995, entitled Seismic Construction System, which Applications were all filed concurrently on Nov. 4, 1993.

BACKGROUND OF THE INVENTION

1. Field of the Invention

This invention relates to an improved surface-mounted veneer anchor for use in conjunction with a wall structure having an inner wythe and an outer wythe. More particularly, the invention relates to construction accessory devices for surface mounting veneer anchors and for embedding a continuous wire in the bed joints of the outer wythe. These accessory devices include captive wire formatives with positive interlocking arrangements. The invention is applicable to an outer wythe of brick facing in combination with an inner wythe of masonry block or dry wall construction.

2. Description of the Prior Art

In the past, investigations relating to the effects of various forces, particularly lateral forces, upon brick veneer masonry construction demonstrated the advantages of having a continuous wire embedded in the mortar joint of anchored veneer walls. The seismic aspect of these investigations were referenced in the inventor's prior patent, namely U.S. Pat. No. 4,875,319. Besides earthquake protection, the failure of several high-rise buildings to withstand wind and other lateral forces has resulted in the incorporation of a requirement for continuous wire reinforcement in the Uniform Building Code provisions. The inventor's related SEISMICLIP® interlock wire clip products and DW-10-X® veneer anchor products (manufactured by Hohmann & Barnard, Inc., Hauppauge, N.Y. 11788) have become widely accepted in the industry. The use of a continuous wire in masonry veneer walls has also been found to provide protection against problems arising from thermal expansion and contraction and improving the uniformity of the distribution of lateral forces in a structure.

The following patents are believed to be relevant and are disclosed as being known to the inventor hereof:

| U.S. Pat. No. | Inventor | Issue Date |
|---|---|---|
| 3,377,764 | Storch | 04/16/1968 |
| 4,021,990 | Schwalberg | 05/10/1977 |
| 4,373,314 | Allan | 02/15/1983 |
| 4,473,984 | Lopez | 10/02/1984 |
| 4,869,038 | Catani | 09/26/1989 |
| 4,875,319 | Hohmann | 10/24/1989 |

It is noted that these devices are generally descriptive of wire-to-wire anchors and wall ties and have various cooperative functional relationships with straight wire runs embedded in the interior and/or exterior wythe. Several of the prior art items are of the pintle and eyelet/loop variety without positive restriction against escape upon vertical displacement.

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977

Discloses a dry wall construction system for anchoring a facing veneer to wallboard/metal stud construction with a pronged sheet-metal anchor. Like Storch '764, the wall tie is embedded in the exterior wythe and is not attached to a straight wire run.

U.S. Pat. No. 4,375,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 02, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued Sep. 26, 1989

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989

Discloses a seismic construction system for anchoring a facing veneer to wallboard/metal stud construction with a pronged sheet-metal anchor. Wall tie is distinguished over that of Schwalberg '990 and is clipped onto a straight wire run.

None of the above provide a surface-mounted veneer anchor for the inner wythe and an outer wythe such as brick veneer having a fixed interconnection on the inner wythe and a precision interlock on the outer wythe as described hereinbelow.

SUMMARY

In general terms, the invention disclosed hereby includes a surface-mounted veneer anchor for use in the construction of a wall having an inner wythe which can either be of dry wall construction or masonry block and an outer wythe. The wythes are in a spaced apart relationship and form a cavity therebetween. In the disclosed system, a unique combination of a masonry anchor, a box tie member, and a facing anchor is provided. The invention contemplates that the primary components of the veneer anchor are wire formatives providing closed loop,wire-to-wire connections therebetween.

In the best mode of practicing this invention, the inner wythe is constructed from a masonry block material, the masonry anchor has a baseplate with a wire formative attached thereto having elongated eye wire extensions. The elongated eye wires extend into the cavity between the wythes. Each pair of eye wires accommodates the threading thereonto of a box tie through the open end of the box tie. The box tie is then positioned so that the open end is utilizable as part of the facing anchor. The baseplate of the masonry anchor is surface-mounted onto the masonry block of the interior wythe. The facing anchor has a straight wire run and mounted along the exterior wythe to receive the open end of wire box tie with each leg thereof being placed adjacent one side of reinforcement wire. The facing anchor is embedded in a bed joint of the exterior wythe. As the elongated eye wires have sealed eyelets or loops and the open ends of the box ties are sealed in the joints of the exterior wythes, a positive, closed-loop interengagement results.

In another mode of practicing this invention, the inner wythe is a dry wall construct, the dry-wall anchor, having a stamped metal baseplate, is attached by sheet-metal screws to the metal vertical channel members of the wall. Each dry-wall anchor accommodates in rolled flanges of the baseplate a wire formative having a pair of elongated eye wires. As in the case of the masonry inner wythe, the open end of the wall tie is then positioned so that the open end is utilizable as part of the facing anchor. The facing anchor has a straight wire run and is mounted along the exterior wythe to receive the open end of wire wall tie with each leg thereof being placed adjacent one side of reinforcement wire. The facing anchor is embedded in a joint of the exterior wythe. Because the elongated eyes of the dry-wall anchor are closed loop and the open ends of the box ties are sealed in the joints of the exterior wythes, a positive interengagement results.

OBJECT AND FEATURES OF TIME INVENTION

It is an object of the present invention to provide in a wall structure having a facing wythe and a backup wythe, a surface-mounted veneer anchor which employs a continuous wire reinforcement in the mortar joint of the facing wythe and is positively interconnected with a wall anchor attached to the backup wythe.

It is another object of the present invention to provide labor-saving devices to aid in the installation of brick and stone veneer and the securement thereof to an inner wythe.

It is yet another object of the present invention to provide a veneer anchor system which ties together the continuous wire reinforcement in a positive manner such that the connective portion in the cavity between the wythes cannot separate.

It is a further object of the present invention to provide a veneer anchor system comprising a limited number of component parts that are economical of manufacture resulting in a relatively low unit cost.

It is yet another object of the present invention to provide a veneer anchor system which restricts lateral and horizontal movements of the facing wythe with respect to the inner wythe, but is adjustable vertically.

It is a feature of the present invention that the box tie, after being threadedly inserted into a veneer anchor, has a reinforcement wire nested therewithin and a portion of the box tie, including the reinforcement wire, embedded in a joint of the facing wythe.

It is another feature of the present invention that the box tie is utilizable with an elongated eye wire for either a masonry block having aligned or unaligned bed joints or for a dry wall construct that secures to a metal studs.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
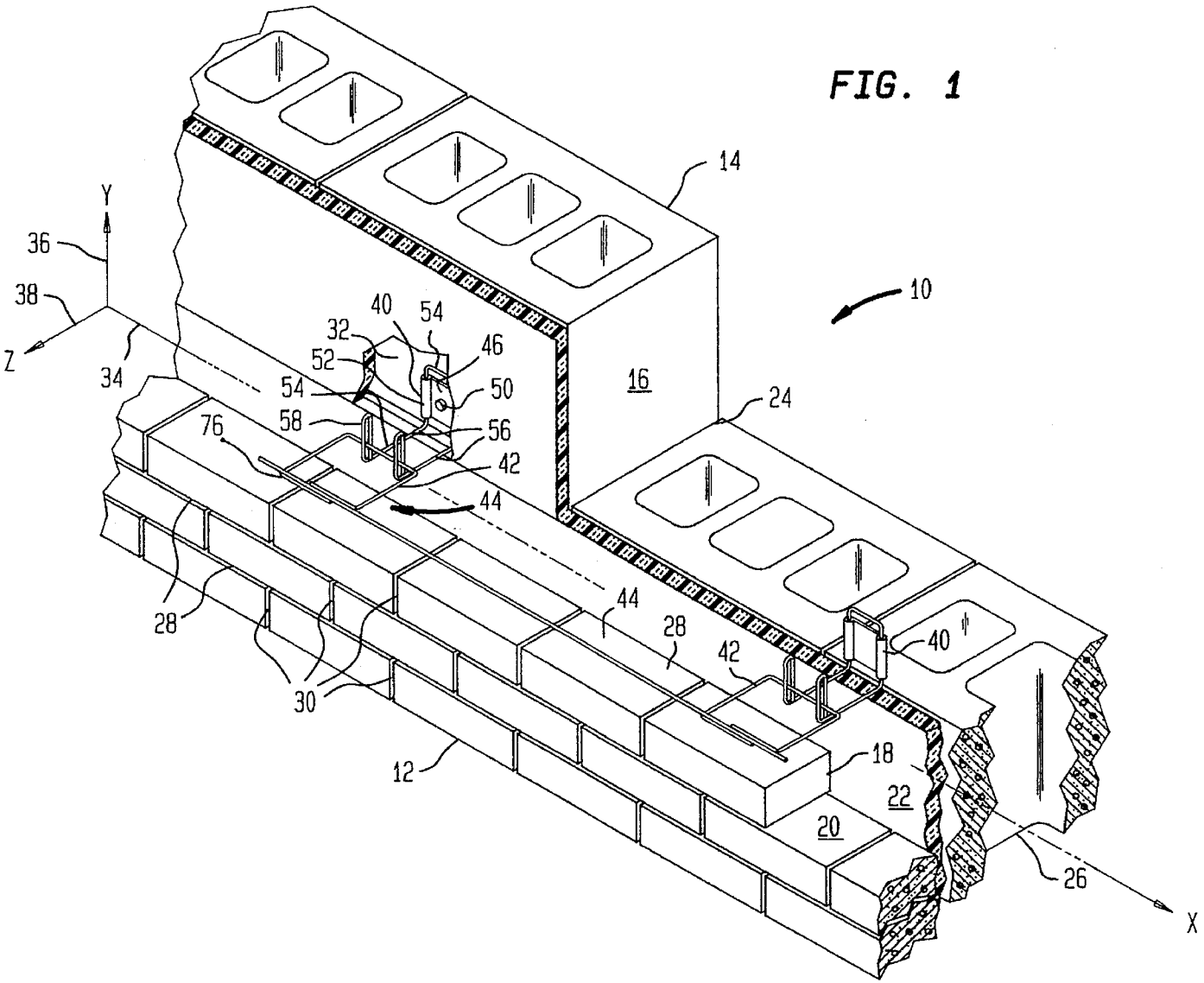
FIG. 1 is a perspective view of a first embodiment of a surface-mounted veneer anchor and shows a wall with an inner wythe of masonry block and an outer wythe of brick veneer, having the bed joints thereof out of alignment with the veneer anchor.
Figure 2:
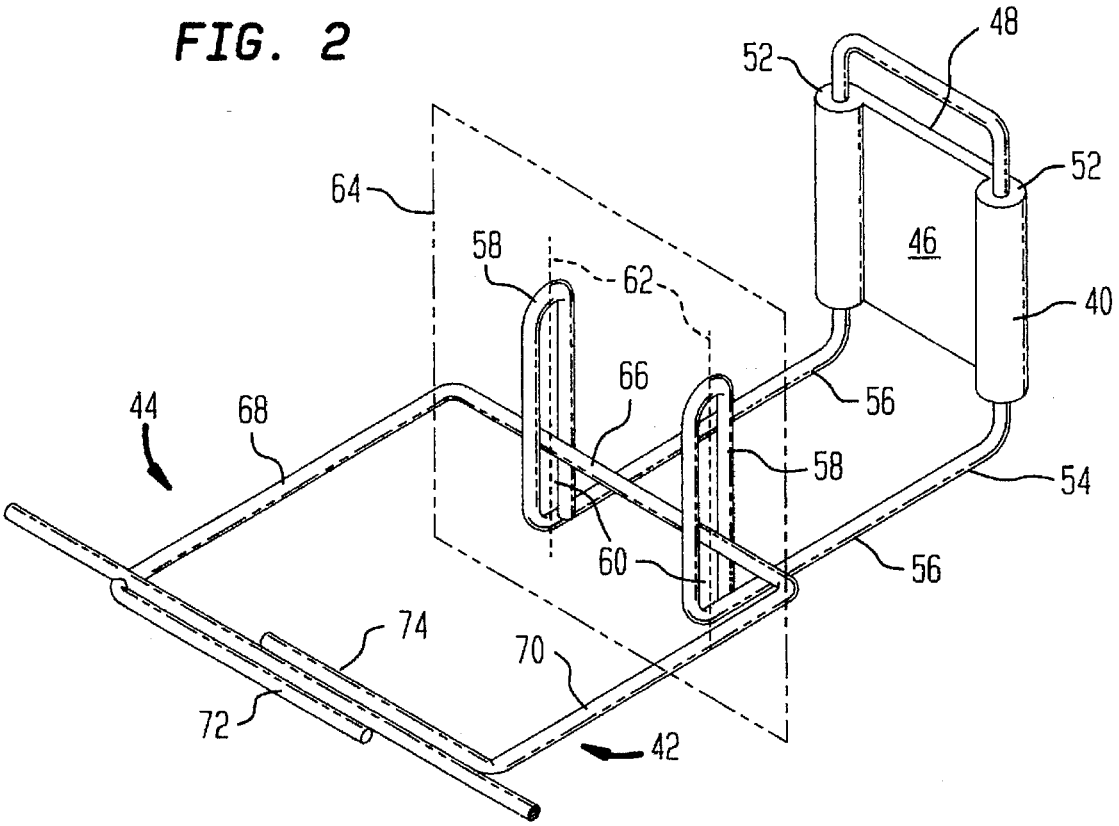
FIG. 2 is a partial perspective view of FIG. 1 showing the veneer anchor and details of the box tie and the reinforcement wire.
Figure 3:
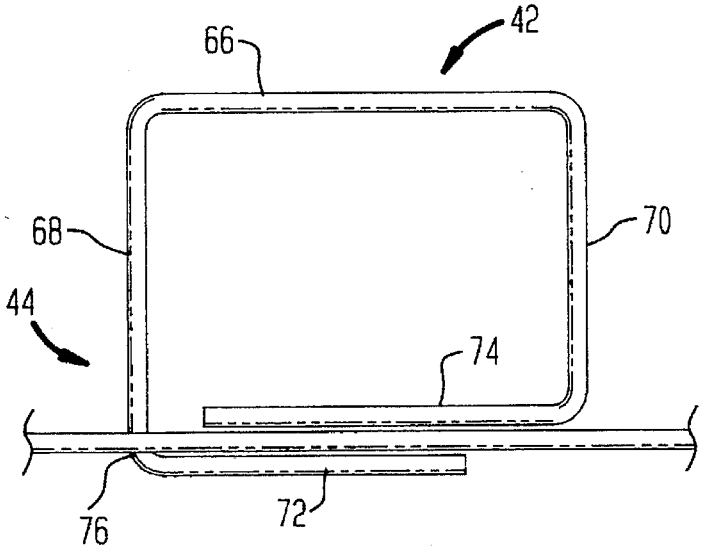
FIG. 3 is a cross-sectional view of the box tie and reinforcement wire of FIG. 2.
Figure 3A:
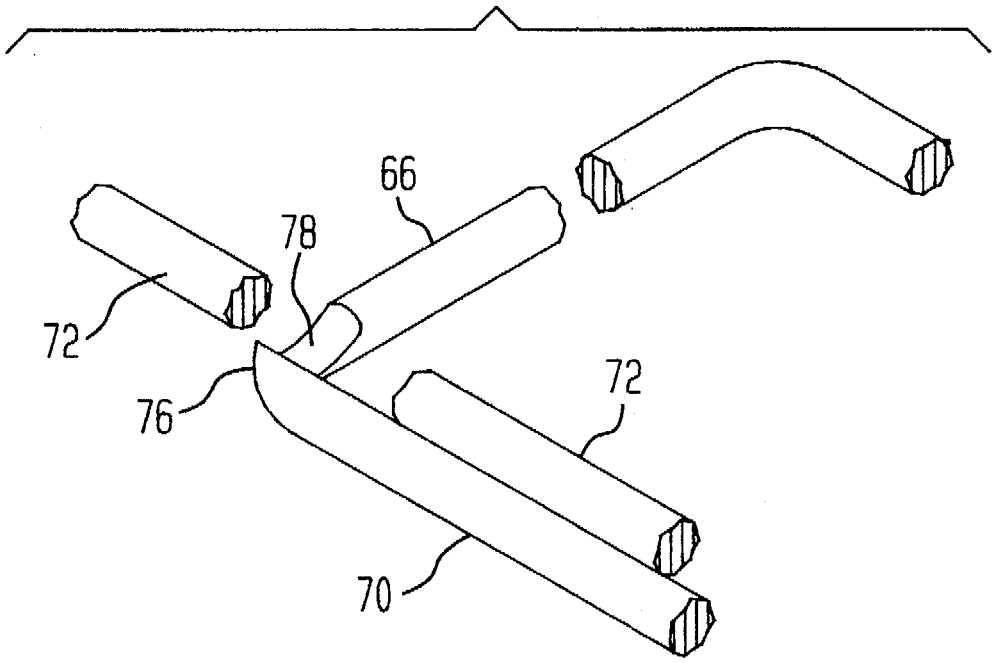
FIG. 3A is a partial perspective view of the box and reinforcement wire of FIG. 2.

Referring now to FIGS. 1 to 3, the first embodiment of a masonry construction system of this invention is shown and is referred to generally by the numeral 10. In this embodiment, a wall structure 12 is shown having an interior wythe 14 of masonry blocks 16 and an exterior wythe 18 of facing brick 20. Between the interior wythe 14 and the exterior wythe 18, a cavity 22 is formed. In the first embodiment, successive bed joints 24 and 26 are formed between courses of blocks 16 and the joints are substantially planar and horizontally disposed. Also, successive bed joints 28 and 30 are formed between courses of bricks 20 and the joints are substantially planar and horizontally disposed. Selected bed joint 24 and bed joint 28 are constructed to align, that is to be substantially coplanar, the one with the other. For purposes of discussion, the exterior surface 32 of the interior wythe 14 contains a horizontal line or x-axis 34 and an intersecting vertical line or y-axis 36. A horizontal line or z-axis 38 also passes through the coordinate origin formed by the intersecting x- and y-axes. Further, it will be seen that the various anchor structures are constructed to restrict movement interfacially—wythe vs. wythe—along the z-axis and, in this embodiment, along the y-axis. The system 10 includes a veneer anchor 40 constructed for affixation to masonry blocks 16 and a box tie device 42 that is constructed to interlock with a reinforcement member 44, both of which are for embedment in bed joint 28. The veneer anchor 40 is shown in FIG. 1 as being affixed to a course of blocks 16. In the best mode of practicing the invention, a sheet-metal plate or baseplate 46 is formed having a rear surface 48 which, when the baseplate 46 is mounted on the masonry block 16 by an attachment device 50, such as explosive-emplaced fastening device, is coplanar with the exterior surface 32 of masonry blocks 16. Although any of a number of methods may be used to attach the baseplate and the wire formative portion of this surface-mounted veneer anchor, the baseplate hereof is constructed with rolled flanges 52 extending forwardly (when viewed as installed) from at least two sides thereof and being dimensioned to accommodate a wire formative mounting wire portion 54 therewithin. A spaced pair of transverse wire member or leg portions 56 are constructed to extend therefrom. These pairs of wire member portions 56 extend into the cavity 22. As will become clear by the description which follows, the spacing therebetween is constructed to limit the x-axis movement of the construct. Each transverse wire member portion 56 has at the end opposite the attachment end an elongated eye wire portion 58 formed continuous therewith. Upon installation, the eye 60 of eye wire portion 58 is constructed to be within a substantially vertical plane (a yz plane) normal to exterior surface 32 and the longitudinal axes 62 of eyes 60 to be within a substantially vertical plane 64 (an xy plane) parallel to exterior surface 32. The spatial relationship between the pair of elongated eyes 60 is constructed so that a box tie device 42 is threadedly emplaceable thereinto by introducing the box tie through the elongated eyes 60 and rotating the box tie device vertically in plane 64. Upon insertion, the box tie device 42 is erectable into a horizontal plane (an xz plane) with the open end dimensioned for embedment in bed joint 28 of brick veneer 20. This relationship minimizes the x- and z-axis movement of the construct. Upon mounting the box tie device 42 in bed joint 28, the closed end 66 thereof is adjustably positionable along axes 62. For positive engagement, the elongated eyes 60 of eye wire portion 58 are sealed forming closed loops. The box tie 42 is a wire formative constructed with a rear or closed end portion 66, a pair of side portions 68 and 70, and a pair of substantially parallel front portions 72 and 74 with an opening or a slot therebetween. The longitudinal axes of portions 66, 68, 70.72, and 74 are substantially coplanar. The opening formed between side portions 68 and 70 is slightly larger than the outer horizontal (viewed as installed) dimension of elongated eyes 60, and when the box tie 42 is threadedly emplaced through the eye opening, the spacing just described controls the x-axis movement of the construct. The substantially parallel front portions 72 and 74 are spaced apart sufficiently to house therebetween reinforcement member 44. The front portion 72 is contiguous with side portion 68, and front portion 74 is contiguous with side portion 70. Adjacent the juncture of the outermost front portion and the contiguous side portion as shown in greater detail in FIG. 3A, an overpass connector 76 is formed in the respective side portion. While the connector 76 is shown as ramping upwardly on the interior side to a flattened overarching portion 78 and as ramping downwardly on the exterior side, a reverse configuration may optionally be employed. Whatever configuration is used, care is exercised that the bed joint 28 height specification is strictly maintained.

Figure 4:
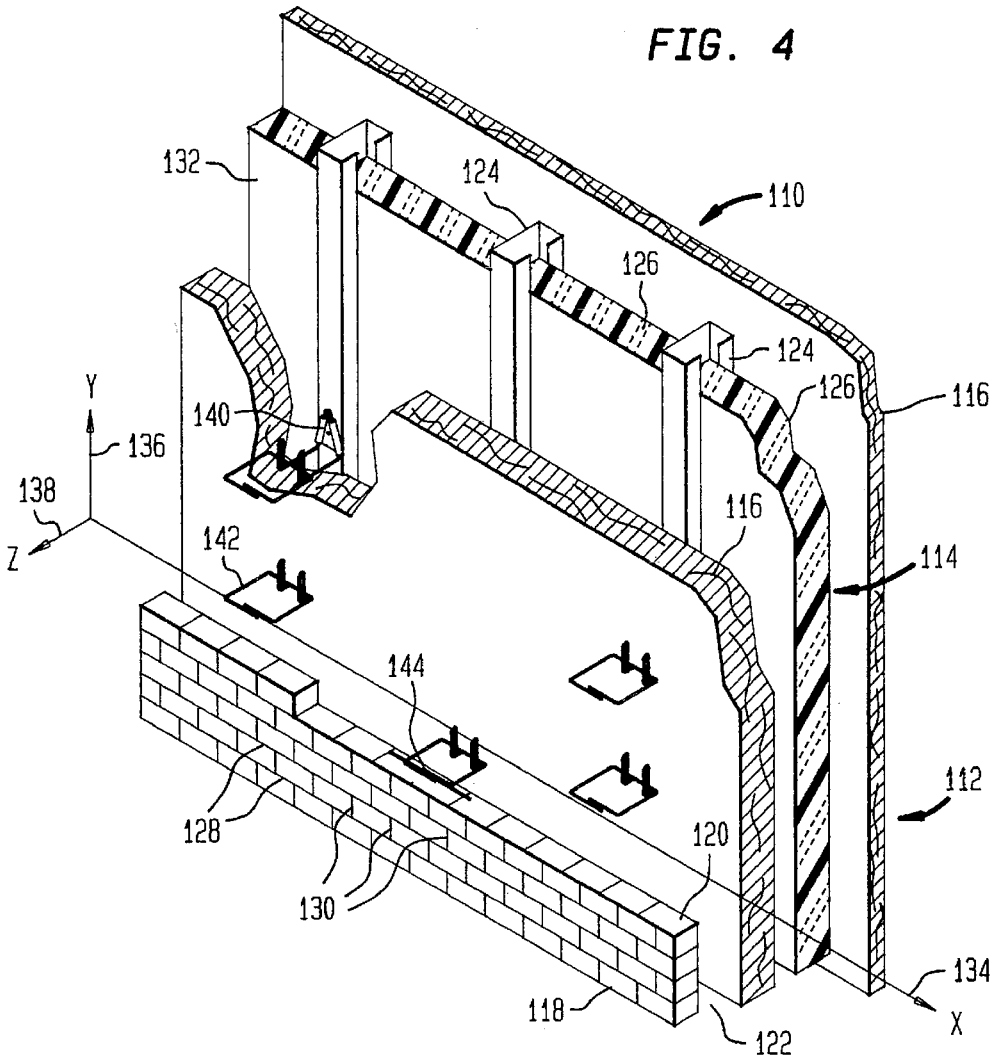
FIG. 4 is a perspective view of a second embodiment of a surface-mounted veneer anchor, but shows a wall with an inner wythe of dry wall construction with metal studs and an outer wythe of brick veneer
Figure 6:
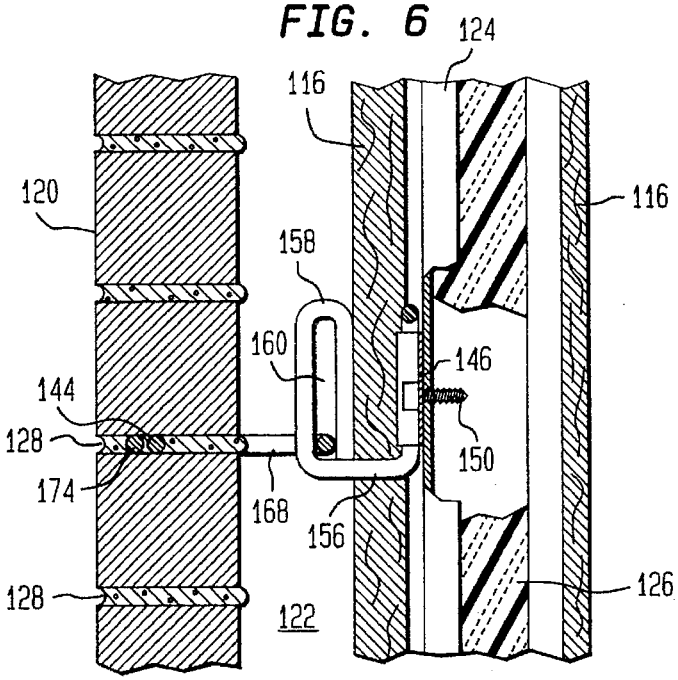
FIG. 6 is a partial cross-sectional view of a surface-mounted veneer anchor of FIG. 4.
Figure 5:
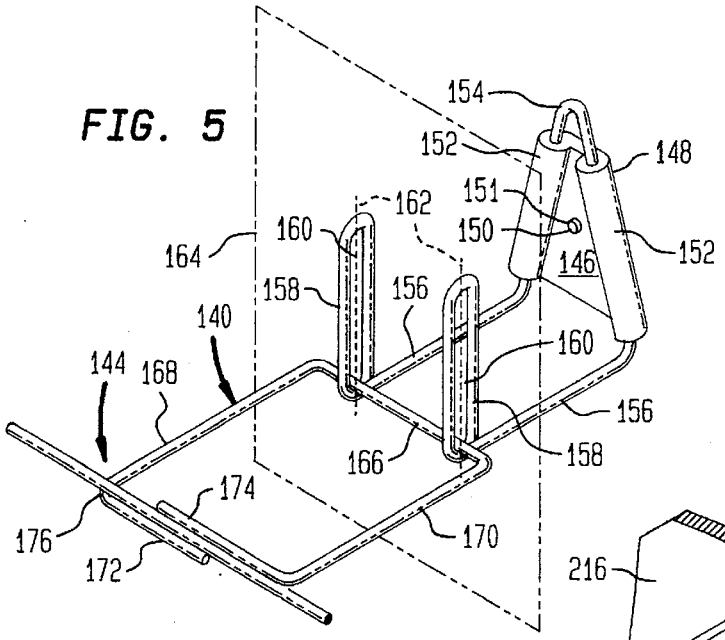
FIG. 5 is a partial perspective view of FIG. 4 showing the veneer anchor and details of the box tie, the wall tie, and the reinforcement wire.

The description which follows is of a second embodiment of the dry wall construction system utilizing the surface-mounted veneer anchor technology. For ease of comprehension, where similar parts are used reference designators "100" units higher are employed. Thus, the wall tie 144 of the second embodiment is analogous to the wall tie 44 of the first embodiment. Referring now to FIGS. 4 to 6, the second embodiment of a dry wall construction system of this invention is shown and is referred to generally by the numeral 110. In this embodiment, a dry wall structure 112 is shown having an interior wythe 114 of wallboard facings 116 and an exterior wythe 118 of facing brick 120. Between the interior wythe 114 and the exterior wythe 118, a cavity 122 is formed. In this embodiment, vertical metal studs 124 with insulating panels 126 therebetween are erected between the interior and exterior wallboard facings 116 and the metals studs 124, having substantially planar facings, are vertically disposed. As in the first embodiment, successive bed joints 128 and 130 are formed between courses of bricks 120 and the joints are substantially planar and horizontally disposed. Sites at a vertical height on metal studs 124 corresponding to bed joint 128 are selected to be substantially coplanar, the one with the other. The extent of vertical misalignment that is tolerated by this system is discussed in greater detail hereinbelow. For purposes of discussion, the exterior surface 132 of the interior wythe 114 contains a horizontal line or x-axis 134 and an intersecting vertical line or y-axis 136. A horizontal line or z-axis 138 also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The system 110 includes surface-mounted a veneer anchor 140 constructed for affixation to metal studs 124 and a box tie device 142 that is constructed to interlock with a reinforcement member 144, both of which are for embedment in bed joint 128. The veneer anchor 140 is shown in FIGS. 5 and 6 as being affixed to a metal stud 124. In the best mode of practicing the invention, a sheet-metal plate or baseplate 146 is formed having a rear surface 148 which, when the baseplate 146 is mounted to the metal stud 124 by an attachment device 150, such as a self-tapping screw fastening device, inserted through aperture 151. The baseplate 146 is constructed with flanges 152 extending forwardly (when viewed as installed) from at least two sides thereof and being dimensioned to accommodate a wire formative 154 therewithin. In the second embodiment, the geometry of the baseplate 146 is distinguished from the generally rectangular baseplate 46, as shown for the first embodiment. Here, the baseplate is basically triangular with the flanges on adjacent sides rather than on opposite sides. A spaced pair of transverse wire member portions 156 are constructed to extend therefrom. These pairs of wire member portions 156 extend into the cavity 122. As will become clear by the description which follows, the spacing therebetween is constructed to limit the x-axis movement of the construct. Each transverse wire member portion 156 has at the end opposite the attachment end an elongated eye wire portion 158 formed continuous therewith. Upon installation, the eye 160 of eye wire portion 158 is constructed to be within a substantially vertical plane (a yz plane) normal to exterior surface 132 and the longitudinal axes 162 of eyes 160 to be within a substantially vertical plane 164 (an xy plane) parallel to exterior surface 132. The spatial relationship between the pair of elongated eyes 160 is constructed so that a box tie device 142 is threadedly emplaceable thereinto by introducing the box tie through the elongated eyes 160 and rotating the box tie device vertically in plane 164. Upon insertion the box tie device 142 is erectable into a horizontal plane (an xz plane) with the open end dimensioned for embedment in bed joint 130 of brick veneer 120. This relationship minimizes the x- and z-axis movement of the construct. For positive engagement, the elongated eyes 160 of eye wire portion 158 are sealed forming closed loops. The box tie 142 is a wire formative constructed with a rear portion 166, a pair of side portions 168 and 170, and a pair of substantially parallel front portions 172 and 174. The longitudinal axes of portions 166, 168,170. 172, and 174 are substantially coplanar. The opening formed between side portions 168 and 170 is slightly larger than the outer horizontal (viewed as installed)

dimension of elongated eyes 160, and when the box tie 142 is threadedly emplaced through the eye opening, the spacing just described controls the x-axis movement of the construct. The substantially parallel front portions 172 and 174 are spaced apart sufficiently to house therebetween reinforcement member 144. The front portion 172 is contiguous with side portion 168, and front portion 174 is contiguous with side portion 170. Adjacent the juncture of the outermost front portion and the continuous side portion in a manner similar to the first embodiment, an overpass connector 176 is formed in the respective side portion. While the connector 176 is shown as ramping upwardly on the interior side to a flattened overarching portion 178 and as ramping downwardly on the exterior side, a reverse configuration may optionally be employed. Whatever configuration is used, care is exercised that the bed joint 128 height specification is strictly maintained.

Figure 7:
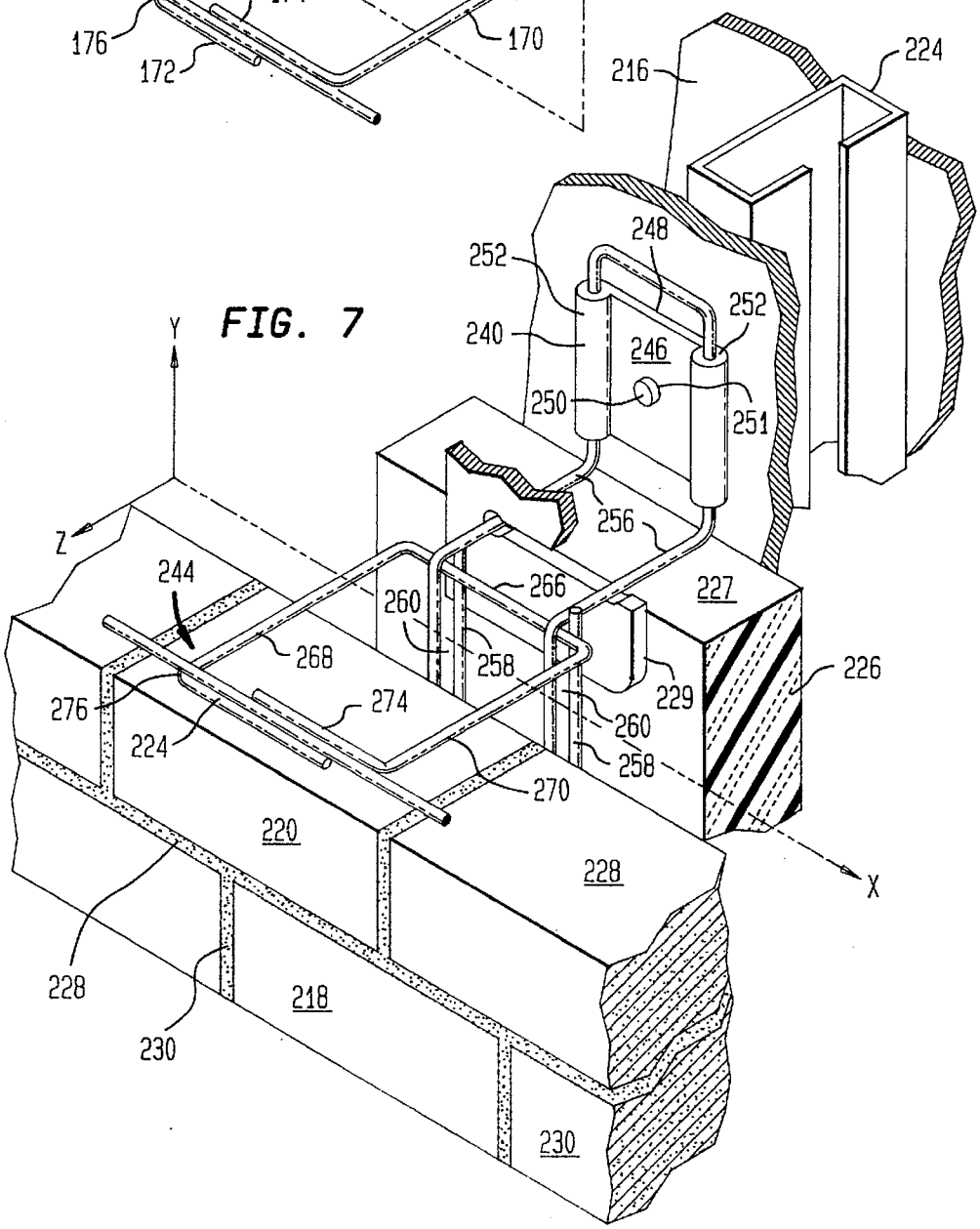
FIG. 7 is a perspective view of a third embodiment of a surface-mounted veneer anchor similar to FIG. 4, but showing a wall with an inner wythe of insulated dry wall.
Figure 8:
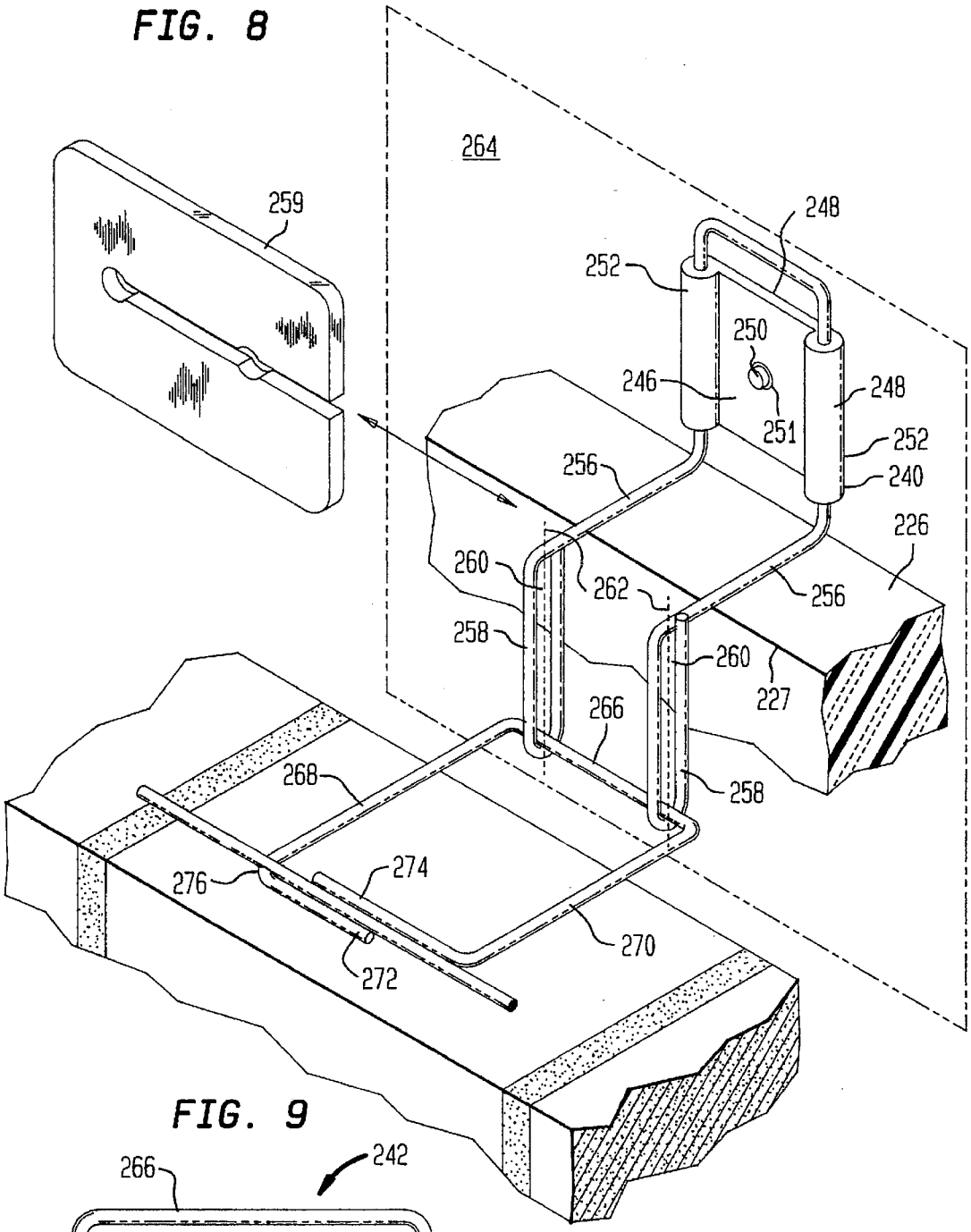
FIG. 8 is a partial perspective view of FIG. 7 showing the veneer anchor and details of the box tie, and the reinforcement wire; and, FIG. 9 is a cross-sectional view of the box tie and the reinforcement wire of FIG. 8.
Figure 9:
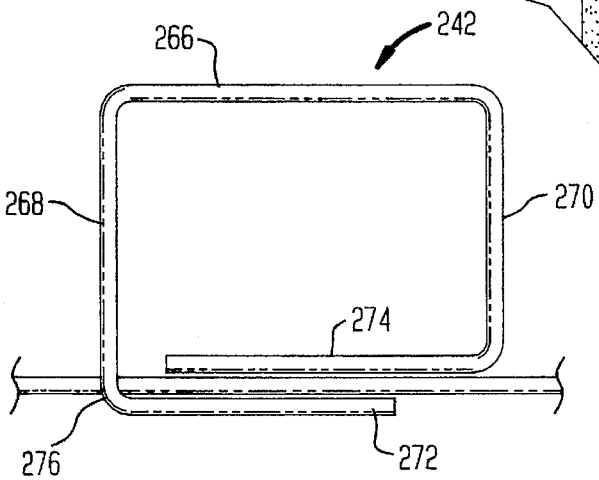

Referring now to FIGS. 7 to 9, the third embodiment of the masonry construction system is shown and is referred to generally by the numeral 210. The dry wall structure 212 is shown having an interior wythe 214 with a wallboard 216 as the interior and exterior facings thereof. An exterior wythe 218 of facing brick 220 is attached to dry wall structure 212 and a cavity 222 is formed therebetween. The dry wall structure 212 is constructed to include, besides the wallboard facings 216, vertical studs or channels 224, insulation layer 226 disposed on the exterior face of exterior wallboard 216. The insulation layer 226 is commonly applied in horizontal strips having horizontal seams 227 between abutting strips. Selected bed joints 228 and 230 are constructed to be in cooperative functional relationship with the surface-mounted veneer anchor described in more detail below. For purposes of discussion, the exterior surface 232 of the interior wythe 214 contains a horizontal line or x-axis 234 and an intersecting vertical line or y-axis 236. A horizontal line or z-axis 238 also passes through the coordinate origin formed by the intersecting x- and y-axes. The system 210 includes a dry wall anchor 240 constructed for attachment to vertical channel members 224, a facing anchor 242 constructed for embedment in joint 228 and an interconnecting wall tie member 244. The veneer anchor 240 is shown in FIGS. 8 and 9 as being affixed to a metal stud 224. In the best mode of practicing the invention, a sheet-metal plate or baseplate 246 is formed having a rear surface 248 which, when the baseplate 246 is mounted to the metal stud 224 by an attachment device 250, such as a self-tapping screw fastening device, inserted through aperture 251. The baseplate 246 is constructed with flanges 252 extending forwardly (when viewed as installed) from at least two sides thereof and being dimensioned to accommodate a wire formative 254 therewithin. In this embodiment, the geometry of the baseplate 246 is similar to that of generally rectangular baseplate 46, as shown for the first embodiment. A spaced pair of transverse wire member portions 256 are constructed to extend therefrom. These pairs of wire member portions 256 extend over the insulation 226 into the cavity 222. As will become clear by the description which follows, the spacing therebetween is constructed to limit the x-axis movement of the construct. Each transverse wire member portion 256 has at the end opposite the attachment end an elongated eye wire portion 258 formed continuous therewith. With the externally applied horizontal strip-type insulation, the eye wire portions 258 are constructed to depend, when installed, downwardly from the transverse wire portion 256 and together with insulation shield 259 hold the insulation 226 in place. Upon installation, the eye 260 of eye wire portion 258 is constructed to be within a substantially vertical plane (a yz plane) normal to exterior surface 232 and the longitudinal axes 262 of eyes 260 to be within a substantially vertical plane 264 (an xy plane) parallel to exterior surface 232. The spatial relationship between the pair of elongated eyes 260 is constructed so that a box tie device 242 is threadedly emplaceable thereinto by introducing the box tie through the elongated eyes 260 and rotating the box tie device vertically in plane 264. Upon insertion the box tie device 242 is erectable into a horizontal plane (an xz plane) with the open end dimensioned for embedment in bed joint 230 of brick veneer 220. This relationship minimizes the x- and z-axis movement of the construct. For positive engagement, the elongated eyes 260 of eye wire portion 258 are sealed forming closed loops. The box tie 242 is a wire formative constructed with a rear portion 266, a pair of side portions 268 and 270, and a pair of substantially parallel front portions 272 and 274. The longitudinal axes of portions 266, 268, 270. 272, and 274 are substantially coplanar. The opening formed between side portions 268 and 270 is slightly larger than the outer horizontal (viewed as installed) dimension of elongated eyes 260, and when the box tie 242 is threadedly emplaced through the eye opening, the spacing just described controls the x-axis movement of the construct. The substantially parallel front portions 272 and 274 are spaced apart sufficiently to house therebetween reinforcement member 244. The front portion 272 is contiguous with side portion 268, and front portion 274 is contiguous with side portion 270. Adjacent the juncture of the outermost front portion and the contiguous side portion in a manner similar to the first embodiment, an overpass connector 276 is formed in the respective side portion. While the connector 276 is shown as ramping upwardly on the interior side to a flattened overarching portion 278 and as ramping downwardly on the exterior side, a reverse configuration may optionally be employed. Whatever configuration is used, care is exercised that the bed joint 228 height specification is strictly maintained.

Although the foregoing description suggests planar box ties 42, 142 and 242, it is within the contemplation of the present invention that a bent box tie is applicable. Also, although all of the box ties are rectangular, other geometric shapes could function satisfactorily. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A veneer anchor for use in the construction of wall structures having an inner wythe and an outer facing wythe in spaced apart relationship forming a cavity between the outer surface of said inner wythe and the inner surface of said outer facing wythe, said veneer anchor comprising:

a baseplate substantially planar in form for mounting to the outer surface of said inner wythe; and, a wire formative attached thereto, said wire formative, in turn, comprising:

a spaced pair of transverse wire portions extending from said baseplate, each transverse wire portion attached at one end thereof to said baseplate and, when the baseplate is secured to said inner wythe, each of said pair of transverse wire portions extends into said cavity and terminates therewithin; and, a pair of elongated eye wire portions formed continuous with each said transverse wire portion and attached thereto at the end opposite the attachment end, said elongated eye wire portion forming an eye adapted, when installed in said wall structure, to be disposed in said cavity and to lie in a plane normal to the inner wythe surface.

2. A veneer anchor as described in claim 1 wherein said baseplate further comprises a pair of rolled flanges, each rolled flange at an edge of said baseplate and said pair of rolled flanges being rolled atop one surface of said baseplate, and each said rolled flange holding therewithin a portion of said wire formative.

3. A veneer anchor as described in claim 2 wherein said wire formative further comprises a mounting wire portion formed continuous with both said transverse wire portions and interconnecting said transverse wire portions at the attachment ends thereof, said mounting wire portion, when assembled to said baseplate, disposed within said rolled flanges.

4. A veneer anchor as described in claim 3 wherein said mounting wire portion is U-shaped, said baseplate is substantially rectangular, and the rolled flanges are on opposite sides of said baseplate.

5. A veneer anchor as described in claim 3 wherein said mounting wire portion is V-shaped, said baseplate is substantially triangular and the rolled flanges are on adjacent legs of said baseplate.

6. A veneer anchor as described in claim 3 further comprising:

a box tie member having a first end portion and a second end portion, said first end portion extending, when installed, from said elongated eye wire portion to said outer facing wythe and being captively disposed in said pair of said elongated eye wire portions and said second end portion disposed, when installed, upon said outer facing wythe.

7. A veneer anchor as described in claim 6 wherein said outer facing wythe is formed from successive courses of bricks, said wall tie further comprises:

a pair of leg portions extending transverse the longitudinal aspect of said successive courses of brick.

8. A veneer anchor as described in claim 7 wherein said outer facing wythe is formed from successive courses of bricks, said wall tie further comprises:

reinforcement wire housing means for encapturing therewithin a reinforcement wire longitudinally disposed on said outer facing wythe, said housing means in said pair of leg portions dimensioned to accommodate a wire reinforcement in a nesting fashion;

at least one reinforcement wire portion disposed longitudinally in said outer facing wythe and adapted to nest within said second end portion of said wall tie member.

9. A veneer anchoring system for use in wall structures having an inner wythe of dry wall construction with supporting vertical metal studs and an outer wythe of a veneer facing, said wythes in spaced apart relationship forming a cavity between the outer surface of said inner wythe and the inner surface of said outer facing wythe, said veneer anchoring system comprising:

a baseplate substantially planar in form for mounting to the outer surface of said inner wythe; and, a pair of rolled flanges, each rolled flange at an edge of said baseplate and said pair of rolled flanges being rolled atop one surface of said baseplate;

a wire formative attached by each of said rolled flanges holding therewithin a portion of said wire formative, said wire formative, in turn, comprising:

a spaced pair of transverse wire portions extending from said baseplate, each transverse wire portion attached at one end thereof to said baseplate and, when the baseplate is secured to said inner wythe, each of said pair of transverse wire portions extends into said cavity and terminates therewithin; and, a pair of elongated eye wire portions formed continuous with each said transverse wire portion and attached thereto at the end opposite the attachment end, said elongated eye wire portion forming an eye adapted, when installed in said wall structure, to be disposed in said cavity and to lie in a plane normal to the inner wythe surface; and, aperture means in said baseplate for housing a fastener therein;

attachment means for attaching said baseplate to said metal stud, said attachment means threadingly engaging said metal stud.

10. A veneer anchoring system as described in claim 9 further comprising:

a box tie member having a first end portion and a second end portion, said first end portion extending, when installed, from said elongated eye wire portion to said outer facing wythe; and, a bed joint for encapsulating and enclosing the open end of said box tie within said outer facing wythe.

11. A veneer anchoring system as described in claim 10 wherein, with said baseplate being surface-mounted to said inner wythe and with said outer facing wythe being formed from successive courses of bricks, said box tie member further comprises:

a pair of side portions extending transverse the longitudinal aspect of said outer wythe; and, a rear portion joining said side portions, said rear portion together with said side portions dimensioned to fit snugly about the pair of elongated eye portions of said veneer anchor.

12. A veneer anchoring system as described in claim 11 wherein said outer facing wythe is formed from successive courses of bricks, said veneer anchoring system further comprises:

said box tie, in turn, further comprising;

reinforcement wire housing means for encapturing therewithin a reinforcement wire longitudinally disposed on said outer facing wythe, said housing means in said pair of leg portions dimensioned to accommodate a wire reinforcement in a nesting fashion;

at least one reinforcement wire portion disposed longitudinally in said outer facing wythe and adapted to nest within said second end portion of said wall tie member.

13. A veneer anchoring system for use in wall structures having an inner wythe of dry wall construction with supporting vertical metal studs and an outer wythe of a brick facing and an insulating layer mounted on the outer surface of said inner wythe, said wythes in spaced apart relationship forming a cavity between the outer surface of said insulating layer and the inner surface of said outer facing wythe, said veneer anchoring system comprising:

a baseplate substantially planar in form for mounting to the outer surface of said inner wythe; and, a pair of rolled flanges, each rolled flange at an edge of said baseplate and said pair of rolled flanges being rolled atop one surface of said baseplate;

a wire formative attached by each of said rolled flanges holding therewithin a portion of said wire formative, said wire formative, in turn, comprising:

a spaced pair of transverse wire portions extending from said baseplate, each transverse wire portion attached at one end thereof to said baseplate and, when the baseplate is secured to said inner wythe, each of said pair of transverse wire portions extends beyond said insulating layer into said cavity and terminates therewithin; and, a pair of elongated eye wire portions formed continuous with each said transverse wire portion and attached thereto at the end opposite the attachment end, said elongated eye wire portion forming an eye adapted, when installed in said wall structure, to depend downwardly in said cavity and to lie in a plane normal to the inner wythe surface, said eye wire dimensioned to abut and secure said insulating layer; and, aperture means in said baseplate for housing a fastener therein;

attachment means for attaching said baseplate to said metal stud, said attachment means threadingly engaging said metal stud.

14. A veneer anchoring system as described in claim 13 further comprising:

a box tie member having a first end portion and a second end portion, said first end portion extending, when installed, from said elongated eye wire portion to said outer facing wythe; and, a bed joint for encapsulating and enclosing the open end of said box tie within said outer facing wythe.

15. A veneer anchoring system as described in claim 14 wherein, with said baseplate being surface-mounted to said inner wythe and with said outer facing wythe being formed from successive courses of bricks, said box tie further comprises:

a pair of side portions extending transverse the longitudinal aspect of said outer wythe; and, a rear portion joining said side portions, said rear portion together with said side portions dimensioned to fit snugly about the pair of elongated eye portions of said veneer anchor.

16. A veneer anchoring system as described in claim 15 wherein said outer facing wythe is formed from successive courses of bricks, said veneer anchoring system further comprises:

said box tie, in turn, further comprising;

reinforcement wire housing means for encapturing therewithin a reinforcement wire longitudinally disposed on said outer facing wythe, said housing means in said pair of leg portions dimensioned to accommodate a wire reinforcement in a nesting fashion;

at least one reinforcement wire portion disposed longitudinally in said outer facing wythe and adapted to nest within said second end portion of said wall tie member.

17. A veneer anchoring system as described in claim 16 wherein said box tie, with the veneer anchor installed, is threadably mountable by rotation, both vertically and parallel to said surface of said inner wythe, into and through both said elongated eye portions.

18. A veneer anchoring system as described in claim 16 wherein said wire formative further comprises a mounting wire portion formed continuous with both said transverse wire portions and interconnecting said transverse wire portions at the attachment ends thereof, said mounting wire portion, when assembled to said baseplate, disposed within said rolled flanges.

19. A veneer anchoring system as described in claim 18 wherein said mounting wire portion is V-shaped, said baseplate is substantially triangular, and the rolled flanges are on adjacent sides thereof.

20. A veneer anchoring system as described in claim 18 wherein said mounting wire portion is U-shaped, said baseplate is substantially rectangular, and the rolled flanges are on opposite sides thereof.

* * * * *